US012545983B2

(12) United States Patent
Mann et al.

(10) Patent No.: US 12,545,983 B2
(45) Date of Patent: Feb. 10, 2026

(54) METHOD FOR MAKING DEFORMED SEMI-FINISHED PRODUCTS FROM ALUMINUM-BASED ALLOYS

(71) Applicant: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

(72) Inventors: Viktor Khrist'yanovich Mann, Moscow (RU); Aleksandr Yur'evich Krokhin, Moscow (RU); Aleksandr Nikolaevich Alabin, Moscow (RU); Aleksandr Vladimirovich Sal'nikov, Krasnoyarsk (RU)

(73) Assignee: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 696 days.

(21) Appl. No.: 16/338,428

(22) PCT Filed: Sep. 30, 2016

(86) PCT No.: PCT/RU2016/000655
§ 371 (c)(1),
(2) Date: Mar. 29, 2019

(87) PCT Pub. No.: WO2018/063024
PCT Pub. Date: Apr. 5, 2018

(65) Prior Publication Data

US 2019/0249284 A1 Aug. 15, 2019

(51) Int. Cl.

| | |
|---|---|
| ***C22F 1/043*** | (2006.01) |
| ***B21B 3/00*** | (2006.01) |
| ***C22C 1/02*** | (2006.01) |
| ***C22C 21/02*** | (2006.01) |
| ***C22F 1/00*** | (2006.01) |
| ***C22F 1/04*** | (2006.01) |

(52) U.S. Cl.
CPC ..... *C22F 1/043* (2013.01); *B21B 3/00* (2013.01); *C22C 1/02* (2013.01); *C22C 1/026* (2013.01); *C22C 21/02* (2013.01); *C22F 1/002* (2013.01); *C22F 1/04* (2013.01); *B21B 2003/001* (2013.01)

(58) Field of Classification Search
None
See application file for complete search history.

(56) References Cited

U.S. PATENT DOCUMENTS

| | | | | |
|---|---|---|---|---|
| 3,613,767 | A | 10/1971 | Cofer et al. | |
| 3,934,446 | A | 1/1976 | Avitzur | |
| 3,958,987 | A | 5/1976 | Chia et al. | |
| 3,989,548 | A * | 11/1976 | Morris | C22C 21/00 148/551 |
| 4,234,359 | A | 11/1980 | Chia et al. | |
| 4,533,784 | A | 8/1985 | Olyphant, Jr. | |
| 4,624,717 | A | 11/1986 | Miller | |
| 5,123,973 | A | 6/1992 | Scott et al. | |
| 2006/0042727 | A1 | 3/2006 | Li et al. | |
| 2009/0223608 | A1 | 9/2009 | Hollrigl et al. | |
| 2013/0334091 | A1 | 12/2013 | Sawtell et al. | |
| 2019/0249284 | A1 | 8/2019 | Mann et al. | |

FOREIGN PATENT DOCUMENTS

| | | | |
|---|---|---|---|
| CN | 101166845 | B | 11/2012 |
| CN | 104694797 | A | 6/2015 |
| EA | 000586 | B1 | 12/1999 |
| EP | 1252351 | B1 | 11/2008 |

(Continued)

OTHER PUBLICATIONS

Kuhlmann, G.W. "Forging of Aluminum Alloys." ASM Handbook, vol. 14A: Metalworking: Bulk Forming, pp. 299-312. 2005. (Year: 2005).*

Lyle et al. "Aluminum Alloys." Ullmann's Encyclopedia of Industrial Chemistry. Posted online Jun. 15, 2000. pp. 1-47. (Year: 2000).*

International Search Report of PCT/RU2016/000655 by the International Searching Authority (ISA/RU), mailing date Jul. 20, 2017. (Original Russian and English translation).

(Continued)

*Primary Examiner* — Brian D Walck
(74) *Attorney, Agent, or Firm* — Seed Intellectual Property Law Group LLP

(57) ABSTRACT

The disclosure relates to metallurgy and can be used to produce deformed semi-finished products as shapes of various cross-sections. Disclosed methods for producing deformed semi-finished products from aluminum-based alloys comprise preparing a melt containing iron and at least one element selected from the group consisting of zirconium, silicon, magnesium, copper, and scandium; producing a continuous casting bar by crystallisation of the melt; producing a deformed semi-finished product of a final or intermediate cross-section by hot rolling of the casting bar, with an initial casting bar temperature being not higher than 520° C. and a degree of deformation being of up to 60%; and additionally using at least one of the following operations: pressing of the casting bar in the temperature range of 300-500° C. by passing of the casting bar through the die, and water quenching of the resulting deformed semi-finished product at a temperature not lower than 450° C.

4 Claims, No Drawings

(56) References Cited

FOREIGN PATENT DOCUMENTS

| | | | |
|---|---|---|---|
| EP | 2698216 | A1 | 2/2014 |
| EP | 3521479 | A1 | 8/2019 |
| EP | 3115473 | B1 | 7/2020 |
| GB | 1442094 | A | 7/1976 |
| GB | 1571512 | A | 7/1980 |
| JP | 09507532 | A | 7/1997 |
| JP | 2004162101 | A | 6/2004 |
| JP | 2010067591 | A | 3/2010 |
| JP | 2010163677 | A | 7/2010 |
| JP | 2016509133 | A | 3/2016 |
| KR | 1020030061013 | A | 7/2003 |
| RU | 2111826 | C1 | 5/1998 |
| TW | 200427850 | A | 12/2004 |
| WO | 9932239 | A1 | 7/1999 |
| WO | 2012011513 | A1 | 1/2012 |
| WO | 2018063024 | A1 | 4/2018 |

OTHER PUBLICATIONS

International Written Opinion of PCT/RU2016/000655 by the International Searching Authority (ISA/RU), mailing date Jul. 20, 2017. (Original Russian).

International Preliminary Report on Patentability of PCT/RU2016/000655 by the International Preliminary Examination Authority (IPEA/RU), mailing date Apr. 2, 2019.

Search Report dated Apr. 3, 2018 in connection with Russian Patent Application No. RU2017113260, 2 pages.

Examiner Requisition and Examination Search Report dated Dec. 17, 2019 in connection with Canadian Patent Application No. 3032801, 4 pages.

Search Report dated Feb. 6, 2020 in connection with Brazilian Patent Application No. BR112019006573-3, 4 pages.

Supplementary European Search Report dated Feb. 13, 2020 in connection with European Application No. 16917843.1, 7 pages.

Notification of Reasons of Refusal dated Apr. 22, 2020 in connection with Japanese Patent Application No. 2019-517210, 6 pages.

First Office Notice dated Sep. 2, 2020 in connection with Chinese Application No. 201680089554.0, 4 pages.

Korean Patent Office Opinion Submission Notice dated Oct. 12, 2021 in connection with Korean Patent Application No. 10-2019-7011848, 5 pages.

Examination Report dated Oct. 23, 2021 in connection with Indian Application No. 201927016018, 6 pages.

Office Notice dated Aug. 26, 2020 in connection with Chinese Application No. 201680895540, 3 pages.

* cited by examiner

METHOD FOR MAKING DEFORMED SEMI-FINISHED PRODUCTS FROM ALUMINUM-BASED ALLOYS

CROSS-REFERENCE TO RELATED APPLICATION

This application is a U.S. National Stage Entry of International Application No. PCT/RU2016/000655 filed on Sep. 30, 2016, the entire contents of which are incorporated herein by reference.

FIELD OF DISCLOSURE

The disclosure relates to metallurgy and can be used to produce deformed semi-finished products as shapes having various cross-sections, rods, rolled sections, wire rods, and other semi-finished products from technical-grade aluminum and technical-grade aluminum-based alloys. Deformed semi-finished products can be used in electrical engineering to produce wiring products and welding wires. Additionally, they can be used in construction and for other applications.

BACKGROUND

Different methods for producing deformed semi-finished products are used to produce products from wrought aluminum alloys. Using wrought aluminum alloys in such methods determines the final level of mechanical properties. At the same time, it is not always possible to achieve an aggregate high level of various physical and mechanical characteristics. For example when high strength properties are achieved, a low plasticity is usually present and vice versa.

The most common method for producing aluminum wire rod includes such steps as continuous casting of a casting bar, rolling to produce wire rod, and subsequent coiling of the wire rod. This method is widely used for the production of electrical wire rod, in particular, from technical-grade aluminum, Al—Zr alloys, and aluminum alloys including those from the 1000 series, 8,000 series, and 6,000 series of alloys. The major producers of this type of equipment are Vniimetmash Holding Company, and Continuus Properzi. The main advantage of this equipment is the high output of potential wire rod production. Some disadvantages include rolling deformation methods not allowing the production of geometrically complicated products such as those having angle sections and other semi-finished products with an asymmetric cross-section. Additionally, a disadvantage is found that when only a rolling method is used, it is usually not possible to achieve a high percentage of elongation and an additional thermal processing is needed to increase the percentage of elongation.

In addition, during one hot-rolling cycle, it is usually impossible to carry out large single-time deformations, which require the consecutive identification of deformation zones, in particular, to use cluster mills. This requires the allocation of large production areas for placing the equipment.

There is another method for producing aluminum alloys, which is reflected U.S. Patent Publication No. US20130334091A1 to Alcoa. The continuous strip casting and thermal processing method disclosed therein includes the following basic operations: continuous strip casting, rolling to get final or intermediate strips, and further hardening. In order to achieve characteristics of a given level, the proposed method provides for the mandatory thermal processing of deformed semi-finished products, in particular, rolled strip, which, in some cases, complicates the production process.

Another existing method for producing wire is disclosed in U.S. Pat. No. 3,934,446. The method involves a continuous wire production process using the following combined steps of rolling of a casting bar and its subsequent pressing. Among the disadvantages of the disclosed method, one should note that there are no process parameters such as casting bar temperatures and degrees of deformation that can ensure the achievement of the required physical and mechanical characteristics.

DETAILED DESCRIPTION

Disclosed herein is a method for producing deformed semi-finished products, which would provide the achievement of an aggregate high level of physical and mechanical characteristics. For example, disclosed methods provide for a high percentage of elongation (minimum 10%), a high ultimate tensile strength, and a high conductivity. Disclosed methods include wrought aluminum alloys alloyed with iron and at least an element of the group consisting of zirconium, silicon, magnesium, nickel, copper, and scandium.

The technical result is the solution of the problem, which is the achievement of an aggregate level of physical and mechanical characteristics in one production stage, excluding multiple production stages, such as separate coil production, hardening, or annealing stages.

Disclosed methods for producing deformed semi-finished products from an aluminum-based alloy include the steps of aluminum a) preparing a melt containing iron and at least an element of the group consisting of zirconium, silicon, magnesium, nickel, copper, and scandium; b) producing a continuous casting bar by crystallisation of the melt at a cooling rate that provides the formation of a cast structure characterised by a dendritic cell size of not more than 70 μm; and c) producing a deformed semi-finished product with a final or intermediate cross-section by hot rolling of the casting bar, with an initial casting bar temperature being not higher than 520° C. and a degree of deformation being of up to 60% (optimally up to 50%). In some embodiments, methods include using at least one of the following operations of pressing of the casting bar in the temperature range of 300–500° C. by passing of the casting bar through the die and water quenching of the resulting deformed semi-finished product at a temperature not lower than 450° C.

In disclosed embodiments, the deformed semi-finished product structure may be an aluminum matrix with some alloying elements and eutectic particles with a transverse size of not more than 3 μm that are distributed therein. In disclosed embodiments, rolling can be carried out at a temperature from about 23° C. to about 27° C. Press-formed products can be rolled by passing them through a number of rolling mill stands.

In some embodiments, disclosed a concentration range of alloying elements includes, by wt. %:

| | |
|---|---|
| Iron | 0.08-0.25 |
| Zirconium | up to 0.26 |
| Silicon | 0.05-11.5 |
| Magnesium | up to 0.6 |
| Strontium | up to 0.02 |

The rationale for the proposed process parameters of the method for producing deformed semi-finished products from this alloy is given below.

Depending on the requirements for the final characteristics, the melt may contain iron and at least one element of the group consisting of Zr, Si, Mg, Ni, and Sc. In some embodiments, a melt may contain iron and at least an element of the group consisting of zirconium and scandium that may used to produce deformed heat-resistant semi-finished products with an operating temperature of up to 300° C. The melt may include iron, silicon, and magnesium that may be used to produce deformed semi-finished products with high strength properties of not less than 300 Mpa. The melt may include iron and at least an element of the group consisting of silicon, zirconium, manganese, silicon, strontium and scandium may be used to produce welding wire. The melt may include iron and at least one element of the group consisting of nickel, copper and silicon may be used to produce thin wire.

The size of structural constituents of casting bars may be directly dependent on the cooling rate in the crystallisation interval, in particular, the size of the dendritic cell, and eutectic components. Therefore, a decrease in the crystallisation rate, at which the formation of a dendritic cell of less than 60 μm might lead to the formation of coarse phases of eutectic origin may impair the processability during subsequent deformation processing. This may result in a decrease in the overall level of mechanical characteristics on thin deformed semi-finished products including thin wire and thin shapes. In addition, a decrease in the cooling rate below the required one may not ensure the formation of a supersaturated solid solution during the crystallisation of the casting bar, in particular, in terms of zirconium content, which may negatively effect the final physical and mechanical characteristics of the deformed semi-finished products.

If the rolling temperature of the initial casting bar exceeds 550° C., dynamic recrystallization processes may occur in the wrought alloy, which may adversely affect the overall strength characteristics of the semi-finished product produced for further use.

For wrought alloys containing zirconium, the initial casting bar temperature should not exceed 450° C., otherwise coarse secondary precipitates of the $Al_3Zr$ ($L1_2$) phase or coarse secondary precipitates of the $Al_3Zr$ ($D0_{23}$) phase may form in the structure.

If the press temperature of the rolled casting bar exceeds 520° C., dynamic recrystallization processes may occur in the wrought alloy, which may adversely affect the overall strength characteristics. If the press temperature of the rolled casting bar is below 400° C., semi-finished products may exhibit worse processability when being pressed.

A decrease in the quenching temperature below 450° C. may result in premature decomposition of the aluminum solid solution, which may adversely affect the final strength properties.

EXAMPLES

Examples of specific implementations of the proposed method are given below.

A disclosed method for producing a casting bar may select for structure parameters for Al—Zr alloys and to a lesser extent for other systems. In particular, for Al—Zr alloys, zirconium should be included into the aluminum solid solution, which is achieved by the steps of:

1) raising the temperature above the liquidus for the Al—Zr system; and
2) controlling the cooling rate during crystallisation.

Although it is almost impossible to measure the cooling rate directly in an industrial plant, the cooling rate may have a direct correlation with the dendritic cell; for this purpose, this parameter may be introduced as a criterion.

Example 1

Under laboratory conditions, casting bars having a cross-section area of 1,520 $mm^2$ were produced from an Al—Zr type alloy containing 0.26 wt. % Zr, 0.24 wt. % Fe, and 0.06 wt. % Si, by weight of the alloy, under different conditions of crystallisation. The crystallisation conditions were varied by varying the heating of the ingot mould. The casting temperature was 760° C. for all examples.

The structure of the casting bar and deformed rod with a diameter of 9.5 mm that were produced by rolling was studied using the metallographic analysis method of scanning electron microscopy. The initial casting bar temperature before rolling was 500° C. The measurement results are given in Table 1.

TABLE 1

Effects of the cooling rate on the casting bar structure and the final size of Fe-containing phases of eutectic origin

| | | Casting bar structure parameters | | |
|---|---|---|---|---|
| No | Cooling rate ° C./s | Average dendritic cell size, μm | Structural constituents | Maximum transverse size of Fe-containing eutectic phases |
| 1 | 3 | 98 | (Al), $Al_3Zr$ ($D0_{23}$), Fe-containing eutectic phases | —* |
| 2 | 5 | 85 | | —* |
| 3 | 7 | 71 | (Al), Fe-containing eutectic phases | 3.8 |
| 4 | 11 | 60 | | 3.1 |
| 5 | 27 | 45 | | 2.5 |
| 6 | 76 | 29 | | 1.6 |

(Al)—aluminum solid solution;
$Al_3Zr$ ($D0_{23}$)—primary crystals of the $Al_3Zr$ phase with a $D0_{23}$ type of structure;
*failure to roll the casting bar due to the presence of primary crystals According to the results given in Table 1, if the casting of casting bar is carried out at a cooling rate of 5° C./s and less, primary crystals of the $Al_3Zr$ ($D0_{23}$) phase form in the Al—Zr alloy structure, which is an irremovable structural defect.

As can be seen from Table 1, it is only at a cooling rate of 7° C./s and higher in the crystallisation interval that the casting bar structure is an aluminum solid solution (Al), against which the ribs of Fe-containing eutectic phases with a size of 3.8 μm and less are distributed.

In order to assess the processability when deforming, wire rod with a diameter of 9.5 mm was produced from casting bar Nos 3-6 (Table 1) and thin wire with a diameter of 0.5 mm was produced from the wire rod. The results relating to the processability when drawing and the determination of the mechanical properties of the annealed wire are given in Table 2.

TABLE 2

Mechanical properties of 0.5 mm diameter wire

| No | $\sigma_{UTS}$, MPa | $\sigma_{0.2}$, MPa | δ, % | Note |
|---|---|---|---|---|
| 3 | — | — | — | Low processability when drawing (breaks) |
| 4 | 130 | 155 | 8 | — |

TABLE 2-continued

| Mechanical properties of 0.5 mm diameter wire | | | | |
|---|---|---|---|---|
| No | $\sigma_{UTS}$, MPa | $\sigma_{0.2}$, MPa | δ, % | Note |
| 5 | 131 | 160 | 10 | — |
| 6 | 131 | 167 | 14 | — |

As can be seen from Table 2, high processability when drawing a thin wire with a diameter of 0.5 mm is ensured only at a cooling rate of 11° C./s and higher, at which eutectic particles of the Fe-containing phase form. High processability is provided by the achievement of the particle size of the Fe-containing phase, the maximum size of which does not exceed 3.1 μm.

Example 2

Deformed semi-finished products in the form of rods with a diameter of 12 mm were produced from an alloy containing 11.5 wt. % Si, 0.02 wt. % Sr, and 0.08 wt. % Fe, by weight of the alloy, by rolling and pressing successively.

The initial cross-sections of the casting bars were as follows: 1,080 $mm^2$, 1,600 $mm^2$, and 2,820 $mm^2$. The rolling of the casting bar and the pressing of the rolled casing bar were carried out at different temperatures. The rolling and pressing parameters are given in Table 3.

TABLE 3

Rolling and pressing parameters for the alloy containing Al, 11.5 wt. % Si, and 0.02 wt. % Sr, by weight of the alloy

| | Rolling | | | | |
|---|---|---|---|---|---|
| Casting bar cross-section $mm^2$ | Initial casting bar temperature ° C. | Final casting bar cross-section $mm^2$ | Degree of deformation in one pass when rolled, % | Pressing Degree of deformation when pressed % | Note |
| 1,080 | 450 | 340 | 56 | 76 | |
| | 450 | 680 | 37 | 83 | |
| | 450 | 960 | 11 | 88 | |
| 1,600 | 450 | 340 | 70 | — | Failure when rolled |
| | 500 | 680 | 58 | — | Failure when rolled |
| | 500 | 960 | 40 | 88 | |
| 2,820 | 500 | 340 | 83 | — | Failure when rolled |
| | 500 | 680 | 76 | — | Failure when rolled |
| | 500 | 960 | 66* | 88 | |

*small cracks when rolled

Example 3

Rods were produced from an alloy containing Al, 0.6 wt. % Mg, 0.5 wt. % Si, and 0.25 wt. % Fe, by weight of the alloy, by various deformation operations including rolling, pressing, and a combined rolling and pressing process. Table 4 shows a comparative analysis of the mechanical properties including tensile strength. The cross-section of the initial casting bar was 960 $mm^2$. The rolling and pressing temperature was 450° C. The final diameter of the deformed rod was 10 mm. The tests were carried out after 48 hours of sample ageing. The design length in the tensile test was 200 mm.

TABLE 4

| Mechanical properties (tensile strength) | | | |
|---|---|---|---|
| Deformation operation | $\sigma_{UTS}$, MPa | $\sigma_{0.2}$, MPa | δ, % |
| Rolling | 182 | 143 | 12 |
| Pressing | 151 | 123 | 25 |
| Rolling and pressing | 165 | 136 | 23 |

From the given results, it follows that the best percentages of elongation (6) are achieved when the casting bar is pressed or pressed and rolled during the combined process. In this case, different percentages of elongation are achieved in the formation of a thin structure during rolling and pressing, in particular, a polygonised structure with an average sub-grain size of not more than 150 forms after pressing, in contrast to rolling when the structure is mainly represented by a cellular structure.

Example 4

Rods were produced from alloys containing Al, 0.45 wt. % Mg, 0.4 wt. % Si, and 0.25% Fe (designation 1) and Al, 0.6 wt. % Mg, 0.6 wt. % Si, 0.25 wt. % Fe (designation 2) (please refer to Table 5), by weight of each alloy, by a combined rolling and pressing process in different modes. The rolling and pressing parameters are shown in Table 5.

The cross-section of the initial casting bar was 960 $mm^2$. When rolled, the degree of deformation was 50%. When pressed, the degree of deformation was 80%. On leaving the pressing machine, the produced rods were intensively cooled with water to obtain a solid solution supersaturated with alloying elements. The cross-section of the initial casting bar was 960 $mm^2$. The rolling and pressing temperature varied in the range from about 520° C. to about 420° C., which made it possible to obtain different temperatures of the press-formed casting bar. When rolled and pressed, the temperature loss ranged from 20° C. to 40° C. The final diameter of the deformed rod was 10 mm. The tests were carried out after 48 hours of sample ageing. The design length in the tensile test was 200 mm.

Table 5 shows a comparative analysis of the percentage of elongation and electrical resistance. The specific electrical resistance values were indicative of the decomposition of the aluminum solid solution (32.5±0.3 and 33.1±0.3 μOhm*mm, respectively, correspond to the supersaturated condition for alloys designation 1 and designation 2 under consideration).

TABLE 5

Percentage of elongation and electrical resistance according to the temperature of the rod after leaving the pressing machine

| Designation | Rod temperature after leaving the pressing machine, ° C. | Specific electrical resistance of wire rod, μOhm/mm | Percentage of elongation, % |
|---|---|---|---|
| 1 | 500 | 32.5 | 23.9 |
| | 450 | 32.5 | 23.7 |
| | 440 | 32.0 | 20.1 |
| | 430 | 31.5 | 18.1 |
| 2 | 500 | 33.1 | 23.9 |
| | 490 | 33.1 | 23.7 |
| | 470 | 32.6 | 20.1 |
| | 460 | 31.5 | 18.1 |
| | 400 | 31.1 | 17.1 |

From the results given in Table 5, it can be seen that a supersaturated solution can be obtained after pressing and intensive cooling with water, if the temperature of the initial casting bar is about 520° C. and the temperature of the pressed casting bar is not lower than 490° C., which, in the case of quenching, provides for the possibility of achieving a supersaturated aluminum solution on the press-formed casting bar.

Example 5

A wire rod with a diameter of 9.5 mm was produced from technical-grade aluminum containing 0.24 wt. % Fe and 0.06% wt. Si, by weight of the alloy, by a combined rolling and pressing process. The wire rod production process involved the following steps. First, a continuous casting of the casting bar was performed at a cooling rate providing the formation of a dendritic cell with an average size of about 30 μm. In this case, the casting bar structure was an aluminum solution, against which the eutectic ribs of the Fe-containing phase with a maximum size of not more than 1.5 μm were distributed. Next, a step of hot rolling at an initial casting bar temperature of about 400° C. with a degree of deformation of 50%. Then, subsequent pressing of the casting bar with a degree of deformation of 78% to produce a 15 mm rod was performed. Then, subsequent rolling of the rod to produce a 9.5 mm wire rod was performed.

Table 6 shows a comparative analysis of the mechanical properties, including tensile strength, of the wire rod produced by the combined process and using conventional equipment for the continuous production of wire rod on the Vniimetmash Holding Company casting and rolling machines.

TABLE 6

Values of mechanical properties ensured by the combined rolling and pressing process and the Vniimetmash Holding Company machine

| Deformation operation | $\sigma_{UTS}$, MPa | δ, % |
|---|---|---|
| Vniimetmash | 105 | 14.5 |
| Rolling & pressing | 108 | 20.5 |

The increased value of elongation of the casting bar produced by the combined method provides for 25% higher values of elongation in comparison with the conventional wire rod production method.

Example 6

A 3.2 mm diameter wire was produced from the 12 mm diameter rods that were produced using a combined rolling and pressing process. The initial casting bar cross-section was 1,520 $mm^2$. When rolled, the degree of deformation was 45%; when pressed, that was 86%. The resulting rods with a diameter of 12 mm were thermally processed at a temperature of 375° C. for 150 hours and the wire was subsequently produced from such rods.

The loss of properties was evaluated after the one-hour-long annealing of the wire at a temperature of 400° C. and calculated based on the ratio:

$$\Delta\sigma=(\sigma_{initial}-\sigma_{anneal})/\sigma_{initial}\cdot 100\%, \text{ where}$$

$\sigma_{initial}$—an initial ultimate strength of the wire $\sigma_{anneal}$—an ultimate strength of the wire after its one-hour-long annealing at 400° C.

TABLE 7

Effects of the parameters of the combined rolling and pressing of the Al-0.25% Zr alloy on the loss of properties of the wire after its one-hour-long annealing at 400° C.

| Casting bar temperature*, ° C. | Rod temperature after leaving the pressing machine*, ° C. | Loss of properties of the wire following its one-hour-long annealing at 400° C., % |
|---|---|---|
| 520 | 500 | 12 |
| 500 | 480 | 9 |
| 470 | 450 | 8 |
| 420 | 400 | 8 |
| 360 | 340 | 6 |
| 320 | 300 | 9 |
| 300 | 270 | 12 |

*During the production process, the casting bar temperature was maintained with an accuracy of 10° C.

From the results shown in Table 7, it can be seen that at a high temperature of the casting bar the loss of properties is 12%, which is associated with an uncontrolled and uneven (fan-shaped) decomposition of the aluminum solid solution, including partial formation of the $Al_3Zr$ phase already during the deformation processing. With the temperature being decreased, no uneven decomposition was observed. When the temperature fell below 300° C., the wire was characterised by higher ultimate tensile strength, which caused a greater decrease in the strength properties during annealing.

The invention claimed is:

1. A method for producing a deformed semi-finished product from an aluminum-based alloy, the method comprising:

a) preparing an aluminum melt comprising:

an iron content from 0.08 weight (wt.) % to 0.25 wt. %;

a zirconium content of up to 0.26 wt. %;

a silicon content from 0.05 wt. % to 11.5 wt. %;

a magnesium content of less than 0.6 wt. %; and a strontium content of less than 0.02 wt. %, by wt. % of the aluminum-based alloy;

b) producing the deformed semi-finished product having one of an intermediate cross-section or a final cross-section in one pass of hot rolling a continuous casting bar obtained from the aluminum melt, wherein:

the continuous casting bar has a cross-section ranging from 1,080 $mm^2$-2,820 $mm^2$, the intermediate cross-section of the semi-finished product ranges from 340 $mm^2$ to 960 $mm^2$, the continuous casting bar is formed by an Al—Zr alloy with zirconium being included in an aluminum solid solution, a dissolution of the zirconium in the aluminum solid solution is achieved by raising the temperature of the Al—Zr alloy above liquidus and increasing the cooling rate of the continuous casting bar higher than 7 K/sec, the continuous casting bar has an initial casting bar temperature of at most 450° C., the deformed semi-finished product has a degree of deformation comprising one in a range from 11% to 37% after the one pass of rolling; and c) extruding the deformed semi-finished product by passing the deformed semi-finished product through a die at a temperature range of 300° C. to 500° C., wherein the structure of the deformed semi-finished product comprises an aluminum matrix having at least one eutectic particle with a transverse size of no more than 3 μm and selected alloying elements that are distributed, including a formation of a polygonised structure with an average sub-grain size of no more than 150 nm during the hot rolling and extrusion.

2. The method of claim 1, wherein the deformed semi-finished product has a strength property of at least 300 MPa, the strength property being tensile strength.

3. The method of claim 1, wherein one of:

the aluminum melt further comprises scandium, and the method further comprises producing a welding wire from the deformed semi-finished product.

4. The method of claim 1, wherein one of:

the aluminum melt further comprises manganese, and the method further comprises producing a wire from the from the deformed semi-finished product.

* * * * *